US006190025B1

(12) United States Patent
Solinsky

(10) Patent No.: US 6,190,025 B1
(45) Date of Patent: Feb. 20, 2001

(54) MULTI-MODE ILLUMINATION DEVICE WITH SECURITY BLOCK

(75) Inventor: Kenneth S. Solinsky, Bedford, NH (US)

(73) Assignee: Insight Technology, Inc., Londonderry, NH (US)

( * ) Notice: Under 35 U.S.C. 154(b), the term of this patent shall be extended for 0 days.

(21) Appl. No.: 09/320,142

(22) Filed: May 26, 1999

Related U.S. Application Data

(60) Provisional application No. 60/100,647, filed on Sep. 14, 1998.

(51) Int. Cl.[7] ..... F21V 23/04; H01H 9/28

(52) U.S. Cl. ..... 362/394; 362/395; 362/200; 362/205; 362/295; 200/43.11; 200/43.16; 200/43.19; 200/43.21

(58) Field of Search ..... 362/394, 395, 362/200, 205, 251, 295; 200/43.11, 43.16, 43.19, 43.21, 43.22, 322, 321, 537

(56) References Cited

U.S. PATENT DOCUMENTS 4,268,894 * 5/1981 Bartunek et al. ..... 362/158
5,410,112 * 4/1995 Freeman ..... 200/50
5,998,743 * 12/1999 Unkel ..... 200/43.11

OTHER PUBLICATIONS

Naval Sea Systems Command, Commercial Laser safety Standard ANSI Z136.1 (1/5–1/5), 1993.*

* cited by examiner

*Primary Examiner*—Sandra O'Shea
*Assistant Examiner*—Ali Alavi
(74) *Attorney, Agent, or Firm*—Hunton & Williams

(57) ABSTRACT

An illumination device includes a housing and a multi-position switch for selecting various modes of operation. A security block is mounted to the housing adjacent the switch. The security block may be attached to the housing in at least two different orientations. In a first orientation, the security block prevents the switch from being in a position corresponding to certain modes (e.g., those which create a high intensity light beam). When positioned in a second orientation, the security block is attached to the housing but permits the switch to be in other or all positions, thereby permitting various modes of operation.

15 Claims, 4 Drawing Sheets

MULTI-MODE ILLUMINATION DEVICE WITH SECURITY BLOCK

This application claims benefit to Provisional Application 60/100,647 filed Sep. 14, 1998.

FIELD OF THE INVENTION

The invention relates to an illumination device with a multi-position switch for controlling the operational mode (e.g., power level and on/off state) of the device and a security block for preventing undesired modes of operation by certain individuals or at certain times.

BACKGROUND OF THE INVENTION

Illumination devices including illuminators and aiming lights, both visible and invisible, using laser, LED or other light sources are generally known. Dual beam illumination devices such as the AN/PEQ-2 manufactured by Insight Technology, Inc. are also known. These devices have two beams of light that may be separately controlled to be on or off. At least one of the beams may be on with a relatively low level of intensity or with a relatively high level of intensity. A multi-position rotary switch to control the on/off state and/or intensity level(s) of the beam(s) is also known.

Various hazards can exist when high intensity beams are used, particularly when a laser light source is used. Laser light is particularly harmful to the human eye. Even brief exposure can cause permanent damage. These and other drawbacks of the prior art are sought to be overcome by the present invention.

SUMMARY OF THE INVENTION

An object of the invention is to overcome these and other drawbacks of known devices.

Another object of the invention is to provide a security block for use in an illumination device to prevent unauthorized or inadvertent use of a particular mode of operation, for example, projection of a high-powered beam.

Another object of the invention is to provide a security block that accomplishes the above object when in one position or orientation and permits operation of the device in other modes when in another position or orientation.

Another object of the invention is to achieve the foregoing objects and add a visual indicator to easily determine the position or orientation of the security block.

Another object of the invention is to achieve the foregoing objects and to allow the inversion of the security block from one position to another with different color coding (or visual indicators) on each respective side.

These and other objects of the invention are carried out in accordance with the embodiments described below. For simplicity, the invention will be described in connection with an AN/PEQ-2. However, the invention is not so limited. The various inventive aspects of the invention may be used with other illumination devices, including single or multi-beam illuminators, aiming lights or combinations thereof, where such devices include visible, infrared, UV, lasers LED, and other sources of light.

By way of example, one embodiment of the invention comprises an AN/PEQ-2 modified to include a security block in the vicinity of a rotatable multi-position switch. According to one aspect of the invention, all modes of operation may be permitted with the security block in a first position or orientation, while only limited modes of operation are permitted with the security block in a second position or orientation. For example, in a first position or orientation, the security block may prevent a multi-position switch from being positioned to cause the device to operate in a mode that would cause the device to emit high intensity light. For example, with the security block in its first orientation, it may permit the switch to be in a position to cause the device to operate in a mode whereby the device emits a first beam and/or second beam with a low-intensity, but precludes the switch from being positioned to cause the device to operate in a mode where the device emits one or more beams with high intensity. Preferably, the security block is secured in the first and second positions or orientations with a special tool, e.g., an Allen wrench. An authorized user, with the use of the special tool, can remove, reposition or reorient the security block to permit or restrict certain modes of operation.

According to one embodiment of the invention, the security block may be inverted from one orientation to another so that it is stored in the same vicinity in the restricted and unrestricted modes. This avoids or reduces the chances of loss of the security block if it were simply removed in an unrestricted mode. However, removal of the security block to permit the unrestricted mode may be permitted. Furthermore, the blocking plate may be color coded. In the embodiment where the security block is inverted, certain advantages can be achieved by having one side of the blocking plate one color and the other side of the blocking plate another color. For example, this permits easy visual inspection of the security block to determine its mode of operation.

These and other features and advantages of the invention will become readily apparent when the detailed description of the preferred embodiments are read in conjunction with the drawings.

DETAILED DESCRIPTION OF THE PREFERRED EMBODIMENT

Figure 1:
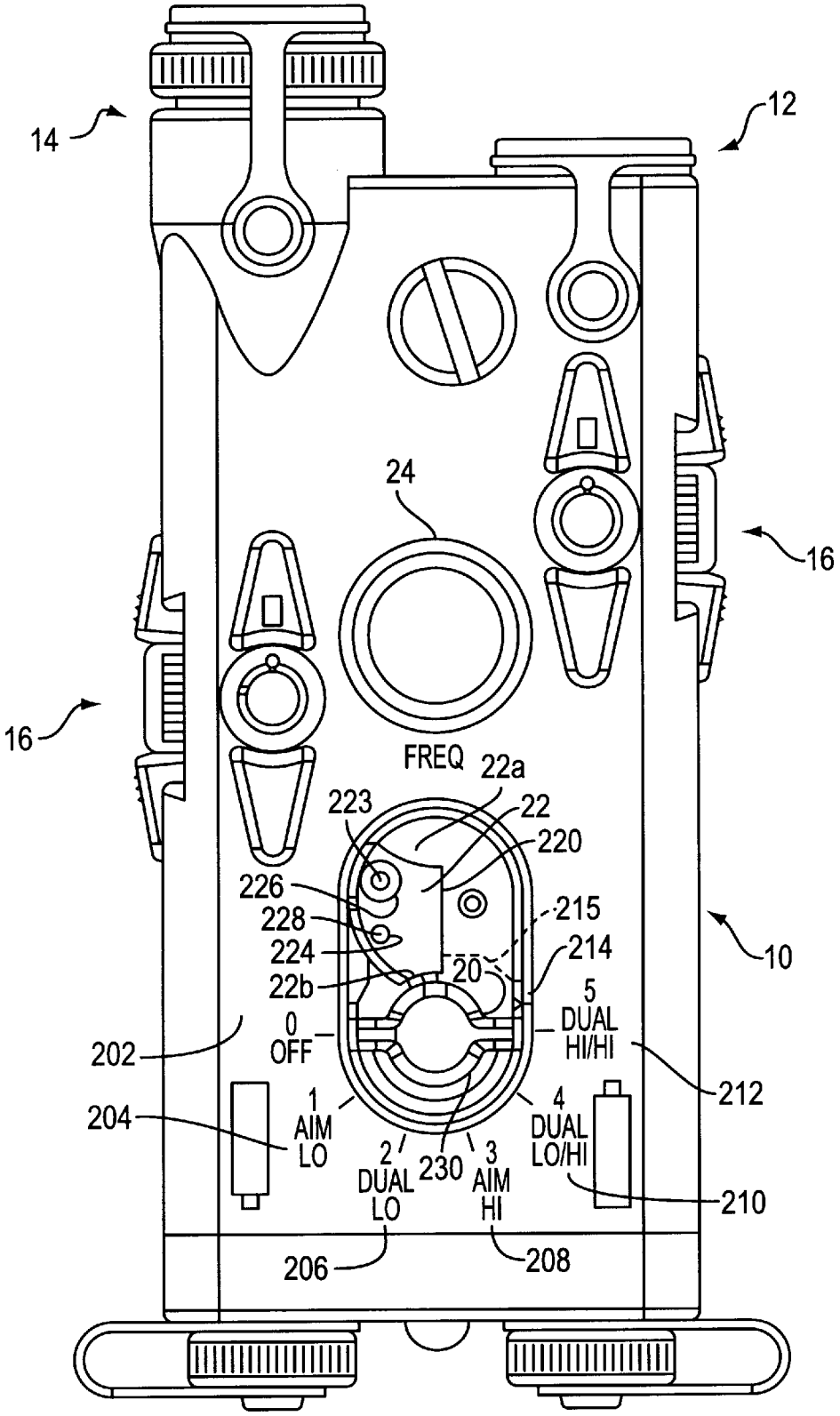
FIG. 1 is a top plan view of an illuminator according to one preferred embodiment of the present invention with the security block in a first orientation.

FIG. 1 depicts an illumination device (such as an AN/PEQ-2). For simplicity, well-known features of the AN/PEQ-2 are not described. Their functions are not critical to understanding the present invention and can be ascertained from publicly available documents. The AN/PEQ-2 comprises a housing 10. The housing 10 has a first light exit 12 that permits a first light beam (e.g., an aiming light) generated within the housing 10 to exit the housing 10. A second light exit 14 permits a second light beam (e.g., an illumination beam) generated within the housing to exit housing 10. The first and second light beams may be generated by one or more light sources (not shown) located in the housing 10.

A multi-position mode selector switch 20 enables a user to control the modes of operation of the illumination device. Various modes of operation are possible. In the example device shown in FIG. 1, these modes may be selected by positioning the switch 20 (e.g., by rotation) to be in one of a plurality of positions. These positions include an off mode position 202 (both beams off), an aim low mode position 204 (aiming light is on with low intensity, illuminator is off), a dual low mode position 206 (both the aiming light and illuminator are on with low intensity), an aim high mode position 208 (aiming light is on in a high mode, illuminator is off), a dual low/high mode position 210 (both beams are on with the aiming light having a low intensity and the illuminator having a high intensity), and a dual high/high mode position 212 (both the aiming beam and illuminator are on in a high intensity mode).

According to one embodiment, the switch 20 includes a flange 214. As the switch 20 is rotated, flange 214 travels along an arcuate path generally indicated by the dotted line 215 in FIG. 1. Security block 22 is provided in the vicinity of switch 20 and is shaped, positioned and oriented with respect to switch 20 to selectively prevent the switch 20 from being positioned in certain positions, thereby preventing certain modes of operation. This may be accomplished by positioning or orienting the security block 22 such that in a blocking mode, the flange 214 is blocked by security block 22 when rotated to certain positions by blocking surface 220 and, in a non-blocking mode, the switch can freely rotate to any position without flange 214 being blocked by the security block 22.

Figure 4:
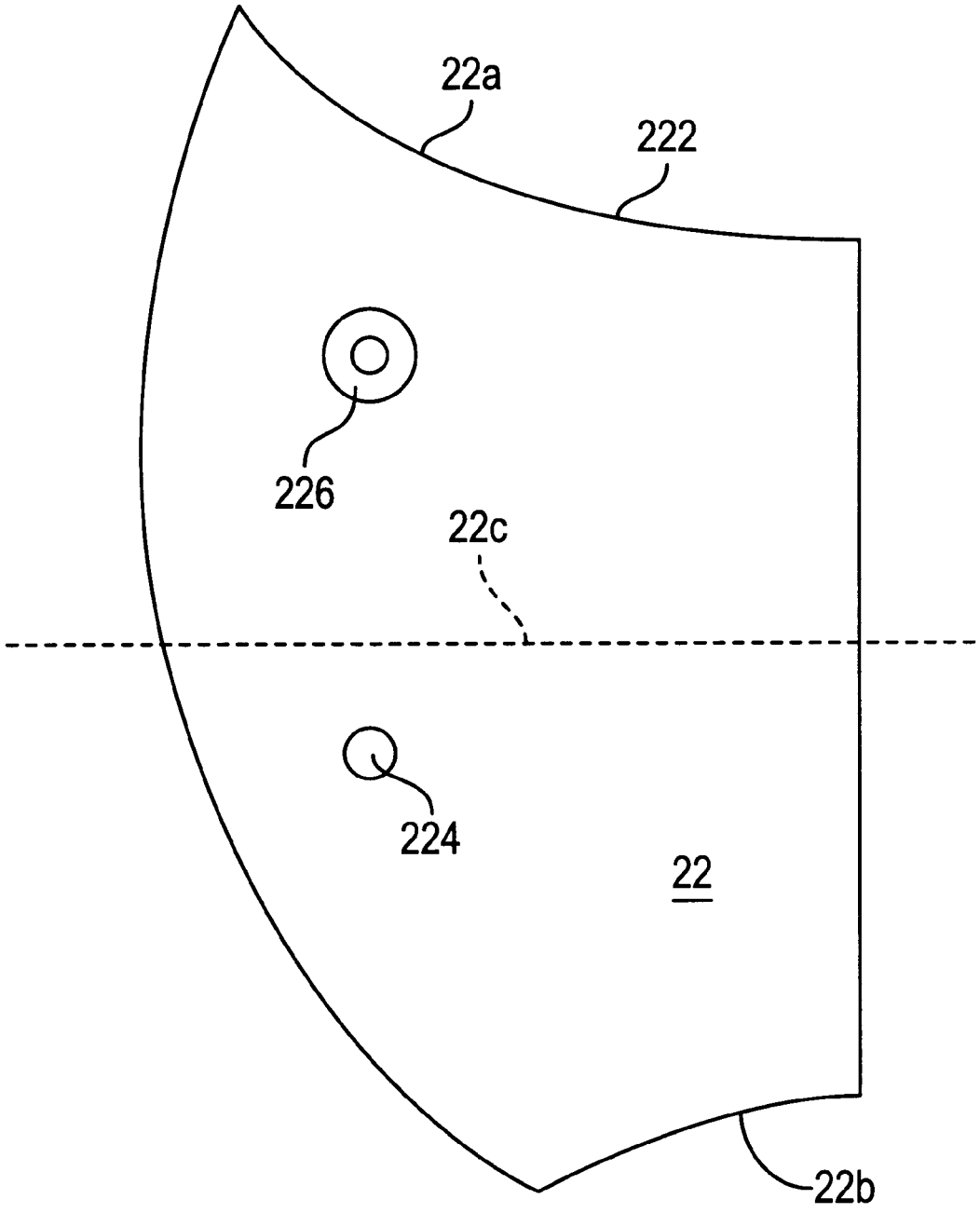
FIG. 4 is a plan view of the security block according to one preferred embodiment.

As shown more clearly in FIG. 4, the security block 22 is shaped such that it has one end 22*a* with one configuration or contour and a second end 22*b* with a second configuration or contour. Additionally, security block 22 has two spaced holes 224, 226. The holes are spaced apart by a predetermined distance, and preferably are non-symmetrical with respect to a central axis 22*c* of the security block 22.

Preferably, the housing 10 has projecting therefrom a rigid post 228 (or other structural projection, preferably rigid as illustrated in FIG. 1) that is sized to substantially correspond to the size of the holes 224, 226. In this way, the security block can be positioned on the post. Due to the non-symmetric spacing of the hole 224, 226, the security block can be positioned in the path of switch 20 or out of the path of switch 20 to block or not block the switch from assuming certain positions, thereby preventing or permitting certain modes of operation. Alternatively, the security block can have posts or other projections, in which case holes or recesses may be formed in the housing 10.

The security block is positioned in substantially the same area of the housing in the blocking and the non-blocking mode. In addition, the mechanism for securing the security block to the housing, i.e., posts may be configured to remain associated with the housing to prevent loss of the securing mechanism.

The mode selector switch 20 is preferably a rotary switch. Detents (not shown) are preferably employed to permit switch 20 to be rotated from one of a plurality of discrete positions to another to select the mode of operation. Preferably, the switch positions are sequenced such that a first group of modes (e.g., low intensity) are sequentially grouped together and a second group of modes (e.g., ones in which one or more of the beams have a high intensity) are sequentially grouped together. This sequencing facilitates the use of a simple security block 22 to limit the rotation of mode selector switch 20 to prevent certain groups of modes of operation when the security block 22 is in a first orientation as shown in FIG. 1. More specifically, with the security block 22 in the orientation shown in FIG. 1, the security block 22 permits the mode selector switch 20 to be in the off position 202, the aim low position 204, or the dual low position 206. However, as the switch 20 is rotated, the flange 214 on the switch 20 comes into contact with a blocking surface 220 of the security block 22 to prevent further rotation of the switch 20 to any of the high intensity positions. Thus, with security block 20 in the first orientation depicted in FIG. 1, the modes of operation of the device can be limited to low intensity modes. Other groupings may be used. Additionally, the invention is not limited to modes defined by low/high intensity. Other characteristics may be used (e.g., visible/invisible, pulsing/continuous, etc.).

Figure 2:
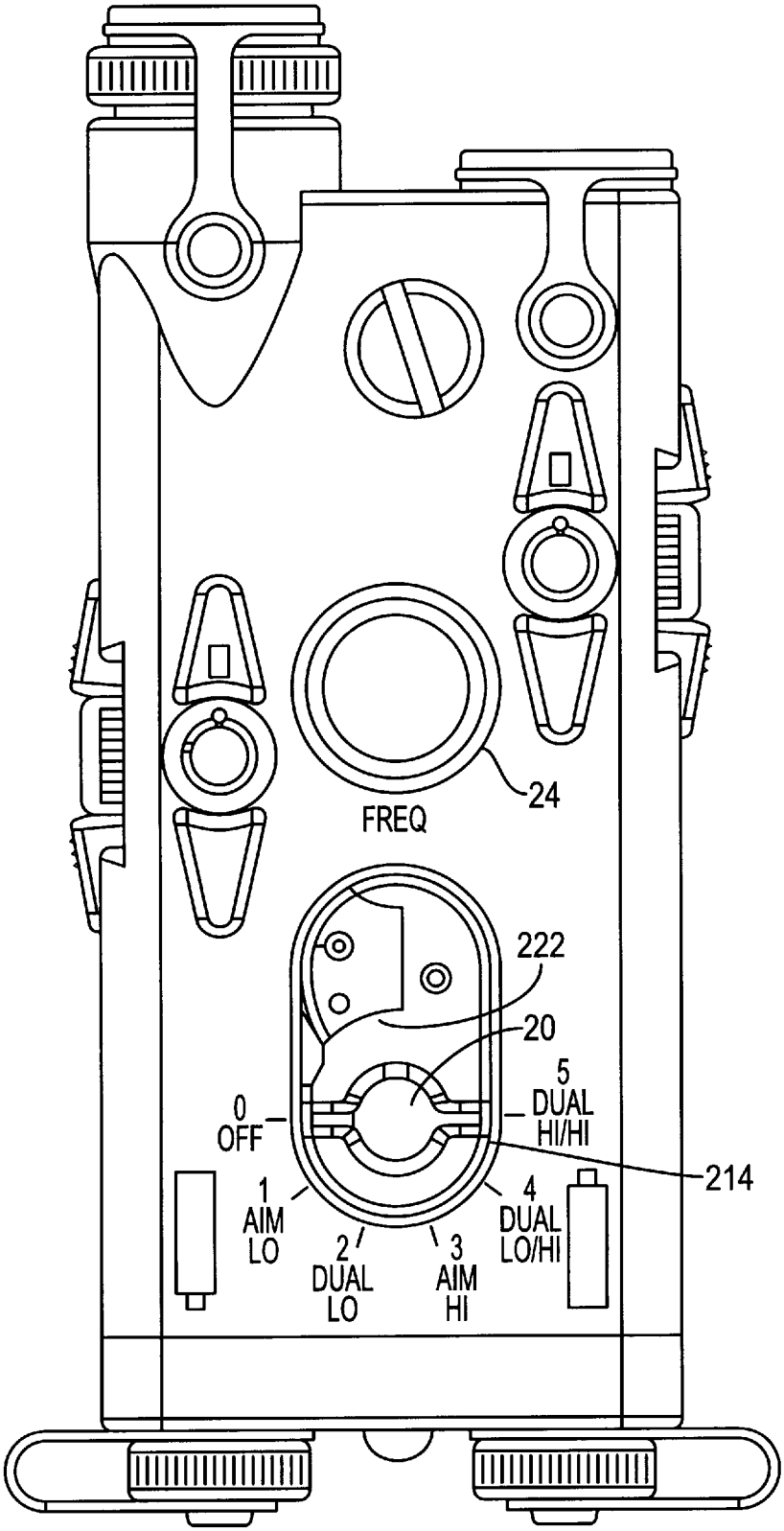
FIG. 2 is a top plan view of the illuminator of FIG. 1 with the security block in a second orientation.

As shown in FIG. 2, the security block 20 has been unscrewed, turned over and refastened thereby positioning it in a second orientation. As can be seen in FIG. 2, the security block 22 is positioned such that a relatively large arcuate recessed portion 222 corresponding to the first end 22*a* is facing switch 20. The geometry of recessed portion 222 is such that when switch 20 is rotated, flange 214 passes by recessed portion 222 and is not blocked by the security block 22. In this second orientation, the mode selector switch 20 is free to rotate to any position, including the high intensity positions.

Figure 3:
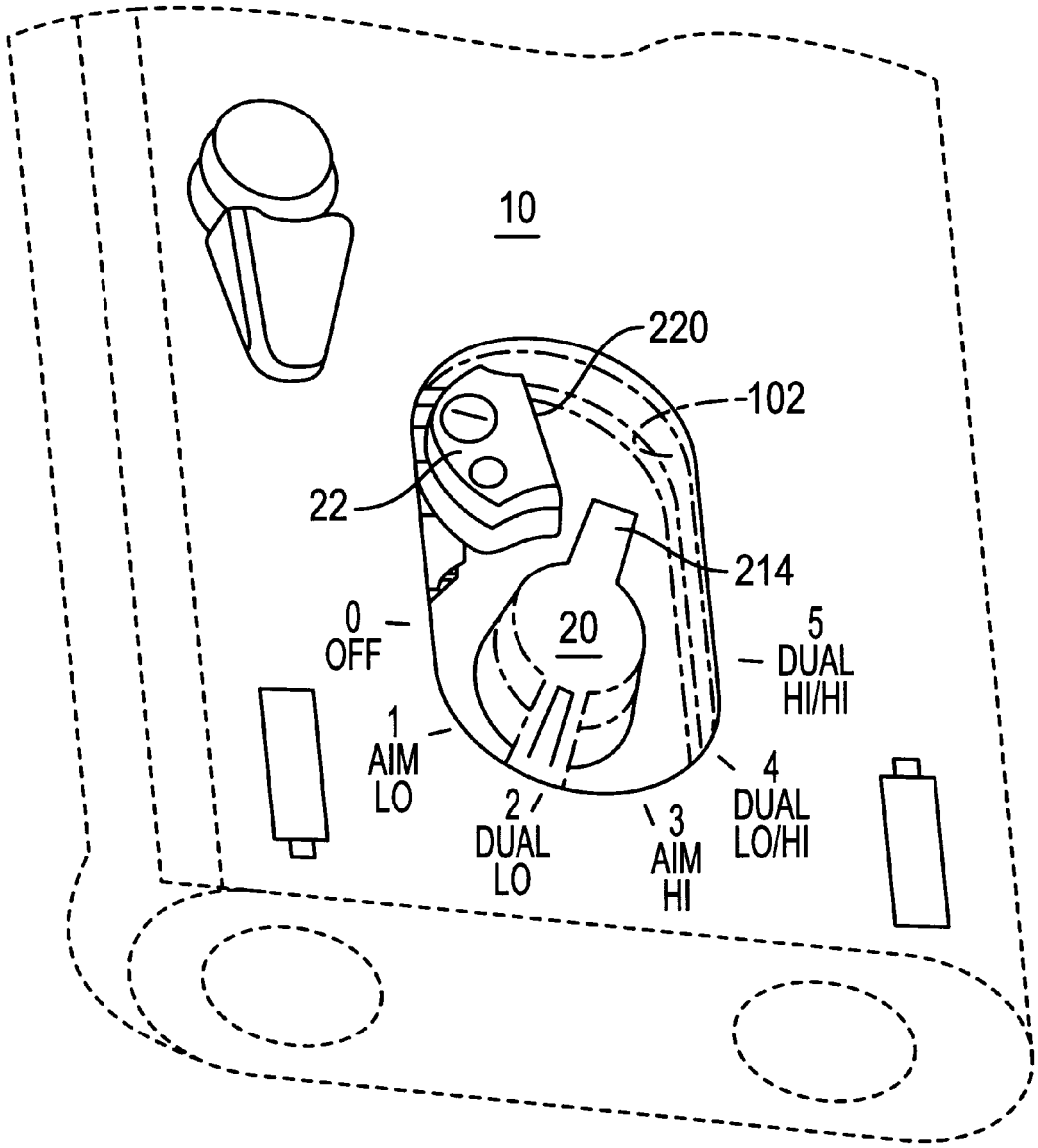
FIG. 3 is a partial perspective view of the illuminator housing showing the rotating switch and security block.

As shown in FIG. 3, the illuminator housing 10 preferably includes a recessed area 102 into which the switch 20 and security block 22 are positioned. The security block 22 as shown in the figure may be dual colored.

Preferably, security block 22 is colored differently on one side than another. For example, one side may be blue and another side may be black (other colors may be chosen). This enables the orientation of the security block 22 and permissible modes of operation of the device to be easily visually determined.

In operation, with the mode selector switch in the desired position, the fire button 24 is depressed to cause the device to be operated according to the selected mode. According to one embodiment, depressing and holding the fire button 24 (FIG. 1) will cause the selected light beam or beams to be projected from the housing 10 until the fire button is released. In another mode, rapidly depressing the fire button 24 twice causes the light beam or beams to be projected from the housing 10 without the need to continuously hold down the fire button 24. When the fire button 24 is depressed a third time, the light beam or beams are turned off. The fire button 24 is not necessary to the invention. The mode selector switch alone may be used to cause the desired mode of operation.

Preferably, security block 22 has the general configuration and shape shown in FIGS. 1–4. However, other shapes and configuration will be readily apparent to one of ordinary skill in the art. An important aspect of the invention resides in the shape, position and/or orientation of the security block relative to the switch 20. Various arrangements can be used such that the security block 22 prevents the mode selector switch 20 from achieving certain positions to prevent certain modes of operation.

Normally, the security block is installed to prevent inadvertent rotation of the mode selector switch to the high power positions. It should be noted, however, if the security block is not installed until the switch is in a high intensity position, subsequent installation could prevent rotation of the switch to a low intensity or off position. If desired, to preclude such installation, the rotary switch may have a webbed area 230 as shown in FIG. 1. For example, webbed area 230 may extend partially around the base of switch 20 (e.g., half-way) to prevent installation of the security block 22 when the switch 20 is rotated to certain positions (e.g., high intensity positions). Web 230 precludes the safety block from being installed in its blocking articulation when the rotary switch is in the high power modes.

One example of the utility of the present invention is that during training operations, it may be desirable to preclude a user from having the ability to put the device in a high intensity mode. One reason for this is that eye damage can result from improperly directing a high intensity light beam. If troops being trained are given the device without the tool necessary to remove and reorient the security block, they can be prevented from operating the device in a potentially unsafe mode until they have been adequately trained. Once trained and in conditions of actual use, the troops can be provided with the special tool necessary to enable the security block to be positioned in either orientation, or a designated individual can re-orient the blocks to enable the device to be used in all operational modes. Additionally, a troop leader can readily determine the orientation setting by looking at whether the blue side or black side of the security block is facing upwards.

As used herein, low intensity and high intensity are used in a relative sense to signify different modes of operation. In certain instances, low intensity may correspond to levels that do not present the risk of eye damage while high intensity corresponds to levels that do. However, the invention is not so limited that other relative levels of intensity or distinctions between beam characteristics may be applicable.

While the AN/PEQ-2 provides a fixed lens for the aiming light and a movable lens to defocus a beam to generate a divergent beam in an illumination mode, the present invention is generally applicable for use in other types of illumination systems, including single or dual beam systems.

While various aspects of the invention have been described in connection with inverting a security block from one orientation to another, the invention is not so limited. Other techniques can be used to selectively enable the security block to be positioned or oriented in a first position or orientation that prevents a multi-position switch from assuming certain positions that cause the device to operate in some modes or in a second position or orientation that permits the switch to assume other positions to cause the device to operate in other or all modes of operation.

The foregoing invention has been described in connection with various preferred embodiments. These embodiments are for illustrative purposes only and are not intended to limit the invention. Various changes and modifications may be made to the preferred embodiment without departing from the scope of the invention.

What is claimed is:

1. An illumination device for projecting one or more beams of light according to one of a plurality of modes of operation, the illuminator comprising:

a housing;

a switch operatively positioned on said housing to select between one of a plurality of modes of operation;

a security block positioned on said housing and adapted to selectively prevent said switch from being positioned to select certain modes of operation;

wherein said security block positioned on said housing is positioned adjacent said switch and said security block includes a blocking surface, and wherein said switch is rotatably secured to said housing and includes a flanged portion extending therefrom, said blocking surface contacting said flanged portion of said switch to prevent the switch from being positioned to select certain modes of operation.

2. The illumination device of claim 1, wherein the modes of operation include at least one mode of operation in which at least one light beam is on with a relatively low intensity and a second mode of operation in which at least one light beam is on with a relatively higher level of intensity, and where said security block prevents the second mode when the security block is in a first orientation.

3. The illumination device of claim 1, said switch being rotatable and comprising at least one flange, said flange rotating through an arcuate path as the switch is rotated, said security block further comprising a blocking surface positioned in said arcuate path to contact the flange when a user attempts to rotate to a position corresponding to certain modes of operation.

4. The illumination device of claim 1, said security block having a pair of holes formed therethrough, said housing including a post formed thereon, the size of the post substantially corresponding to the size of holes formed in the security block such that said security block can be removably positioned on said housing by said post.

5. The illumination device of claim 1, said security block comprising a first end surface and a second end surface and further comprising a first recessed portion formed along the first end surface thereof, said recessed portion permitting, when said security block is oriented with said first end surface facing toward said switch, said flange on said switch to pass by said security block to allow the switch to be positioned in any of a plurality of positions.

6. The illumination device of claim 1, said security block being releasably attached to said housing and capable of being removed, inverted and repositioned on the housing.

7. An illumination device for projecting one or more beams of light according to one of a plurality of modes of operation, the illuminator comprising:

a housing;

a switch operatively positioned on said housing to select between one of a plurality of modes of operation;

a security block positioned on said housing and adapted to selectively prevent said switch from being positioned to select certain modes of operation; and means associated with the security block for preventing the block from being inadvertently positioned so that it does not block the intended modes of operation.

8. The illumination device of claim 1, said housing including a recessed portion into which said switch and security block are located.

9. The illuminator of claim 1, said security block having distinct visual indicators on opposing sides to visually indicate the orientation of the security block.

10. The illumination device of claim 9, wherein the visual indicators comprise one color on one side of the security block and another color on an opposing side of the security block.

11. The illumination device of claim 1, said security block being releasably attached to said housing and capable of being removed and repositioned on the housing to convert from a blocking mode to a non-blocking mode.

12. The illumination device of claim 11, wherein the security block is located in substantially the same area of the housing whether in the blocking mode or non-blocking mode.

13. The illumination device of claim 1, said security block comprising means for securing the security block to the housing, wherein said means for securing remain associated with the security block when the security block is removed from the housing to prevent loss of the means for securing.

14. An illumination device for projecting one or more beams of light according to one of a plurality of modes of operation, the illuminator comprising:

a housing;

a switch operatively positioned on said housing and movable to one of a plurality of positions, each of the plurality of positions corresponding to an on position for one of a plurality of modes of operation of the illuminating device;

a security block positioned on said housing and adapted to selectively prevent said switch from being positioned to select certain modes of operation; and wherein the switch may be positioned for selected ones of the plurality of positions, the selected ones of the plurality of positions of the switch having at least one common characteristic and sequenced together so that the security block can permit the switch to be moved to selected ones of the plurality of modes of operation corresponding to the selected ones of the plurality of positions and prevent the switch to be moved to other modes of operation.

15. An illumination device for projecting one or more beams of light according to one of a plurality of modes of operation, the illuminator comprising:

a housing;

a switch operatively positioned on said housing to select between one of a plurality of modes of operation;

a security block positioned on said housing and adapted to selectively prevent said switch from being positioned to select certain modes of operation;

wherein said switch is rotatable and comprises at least one flange, said flange rotating through an arcuate path as the switch is rotated, and wherein said security block further comprises a blocking surface positioned in said arcuate path to contact the flange when a user attempts to rotate to a position corresponding to certain modes of operation.

* * * * *